US006938526B2

(12) United States Patent
Milbourne et al.

(10) Patent No.: US 6,938,526 B2
(45) Date of Patent: Sep. 6, 2005

(54) IMPACT WRENCH HAVING AN IMPROVED ANVIL TO SQUARE DRIVER TRANSITION

(75) Inventors: Rodney Milbourne, Abingdon, MD (US); Steve Debelius, Mission, TX (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 10/630,263

(22) Filed: Jul. 30, 2003

(65) Prior Publication Data

US 2005/0022637 A1 Feb. 3, 2005

(51) Int. Cl.[7] ..... B25B 21/00

(52) U.S. Cl. ..... 81/466; 81/177.85; 173/93.6; D8/70

(58) Field of Search ..... 81/466, 465, 177.85; 173/93.5, 93.6, 93; 403/20, 361; D8/70

(56) References Cited

U.S. PATENT DOCUMENTS

| | | | |
|---|---|---|---|
| 2,954,994 | A | 10/1960 | Beers |
| 3,119,456 | A | 1/1964 | Burnett |
| 3,180,435 | A | 4/1965 | McHenry |
| 3,428,137 | A | 2/1969 | Schaedler et al. |
| 3,605,914 | A | 9/1971 | Kramer |
| 3,734,515 | A | 5/1973 | Dudek |
| 3,890,051 | A | 6/1975 | Biek |
| 4,513,827 | A | 4/1985 | Dubiel |
| 4,865,485 | A | 9/1989 | Finnefrock, Sr. |
| 5,038,869 | A | 8/1991 | Olson |
| 5,438,894 | A | 8/1995 | Pearce |
| D384,563 | S | 10/1997 | Robinson |
| 6,446,735 | B1 | 9/2002 | Chen |
| 2002/0152848 | A1 | 10/2002 | Johnson |

FOREIGN PATENT DOCUMENTS

| | | | |
|---|---|---|---|
| DE | 1478993 | | 1/1962 |
| DE | 1603945 | | 3/1967 |
| DE | 1939262 | C2 | 8/1969 |
| DE | 2508316 | C2 | 2/1975 |
| DE | 4402739 | C2 | 1/1994 |
| DE | 20118029 | U1 | 11/2001 |
| DE | 20201733 | U1 | 2/2002 |
| EP | 1014081 | | 12/1965 |
| EP | 0092127 | A2 | 4/1983 |
| EP | 0719618 | B1 | 7/1996 |
| EP | 0721823 | B1 | 7/1996 |
| EP | 0747174 | B1 | 12/1996 |
| EP | 0885693 | B1 | 12/1998 |

*Primary Examiner*—Debra S. Meislin
(74) *Attorney, Agent, or Firm*—Harness, Dickey & Pierce, P.L.C.

(57) ABSTRACT

An anvil adapted to be received within an impact wrench comprises a round body and a square head. The square head is formed at an end of the round body. A tapered ramp extends from the round body to the square head. A radius is formed in the tapered ramp. The radius is defined by a removal of material in the tapered ramp.

8 Claims, 2 Drawing Sheets

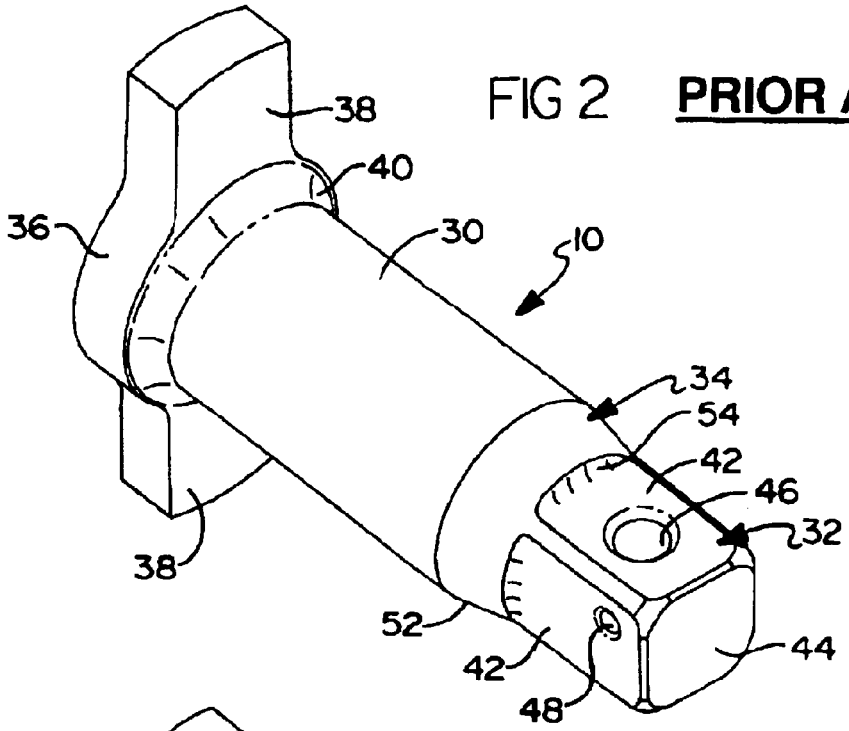
FIG 2 PRIOR ART
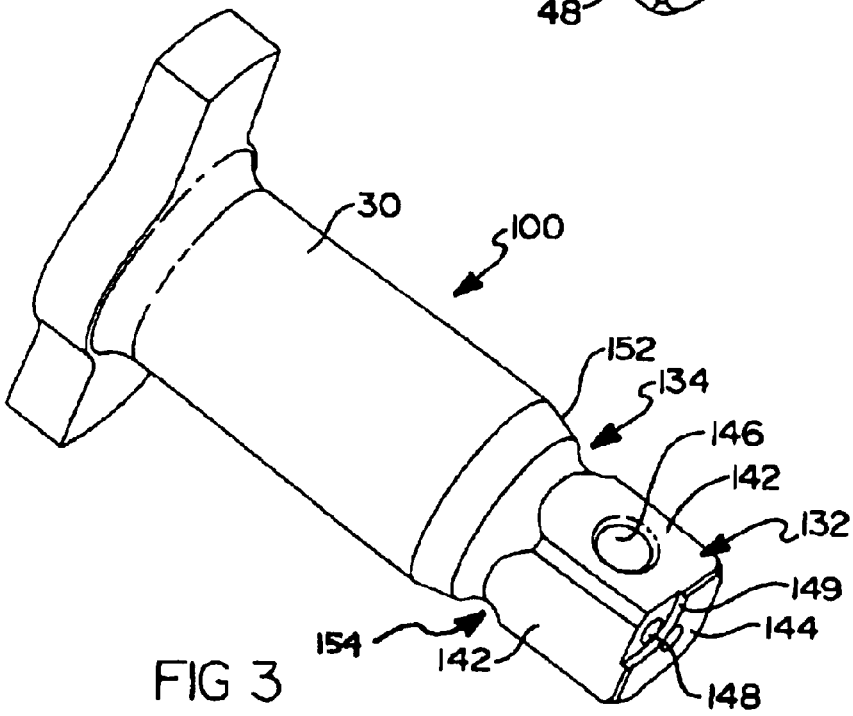
FIG 3

IMPACT WRENCH HAVING AN IMPROVED ANVIL TO SQUARE DRIVER TRANSITION

FIELD OF THE INVENTION

The present invention relates to an impact wrench and more particularly to an improved anvil in an impact wrench.

BACKGROUND OF THE INVENTION

The traditional design of an anvil for use in an impact wrench includes a round portion that transitions to a square portion. The round portion is received within the impact wrench and acts as a bearing journal. The square portion is received within an impact socket. The transition from the round cross section to the square cross section inherently creates sharp radii within the transition.

These sharp radii may create some inefficiencies in the design. Initially there is minimal clearance between the square portion of the anvil and the impact socket when the pieces are new. However, the impact socket may, over a long period of use, become "damaged", resulting in a looser fit to the square portion of the anvil. This increased clearance between the square portion interface and the impact socket allows the centerline of the square portion of the anvil and the centerline of the impact socket to become non-parallel. When this occurs, the theoretical line contact between the two that exists axially along the interface of the square portion and the impact socket become points of contact. These points of contact form at the sharp radii in the transition between the round body and the square drive and lead to points of increased stress.

Moreover, as the impact socket becomes "damaged", the corners of the impact socket tend to "dig" into the sharp radii in the transition. This digging between the impact socket and the square portion can damage the anvil.

Sharp radii also act as stress concentration zones within the anvil. As the stress builds at these points, the anvil may fail at the sharp radii. This then can contribute to an early failure of the anvil.

One solution to the problem of sharp radii in an anvil is to increase the overall strength of the anvil. For example, a thermo cryogenic treatment can be applied to the anvil during manufacturing. However, this added step increases the overall cost of manufacturing the anvil and does not directly address the problems associated with the sharp radii.

Accordingly, there remains a need in the art to provide an improved anvil design that eliminates the stress concentration zones and prolongs the life of the anvil while simultaneously reducing costs associated with its manufacture.

SUMMARY OF THE INVENTION

An anvil adapted to be received within an impact wrench is provided. The anvil comprises a round body and a square head formed at an end of the round body. A tapered ramp extends from the round body to the square head. A radius is formed in the tapered ramp. The radius is defined by a removal of material in the tapered ramp.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 2 is a perspective view of a prior art anvil;

FIG. 3 is a perspective view of the anvil according to the principles of the present invention.

DETAILED DESCRIPTION OF THE PREFERRED EMBODIMENTS

The following description of the preferred embodiment is merely exemplary in nature and is in no way intended to limit the invention, its application, or uses.

Figure 1:
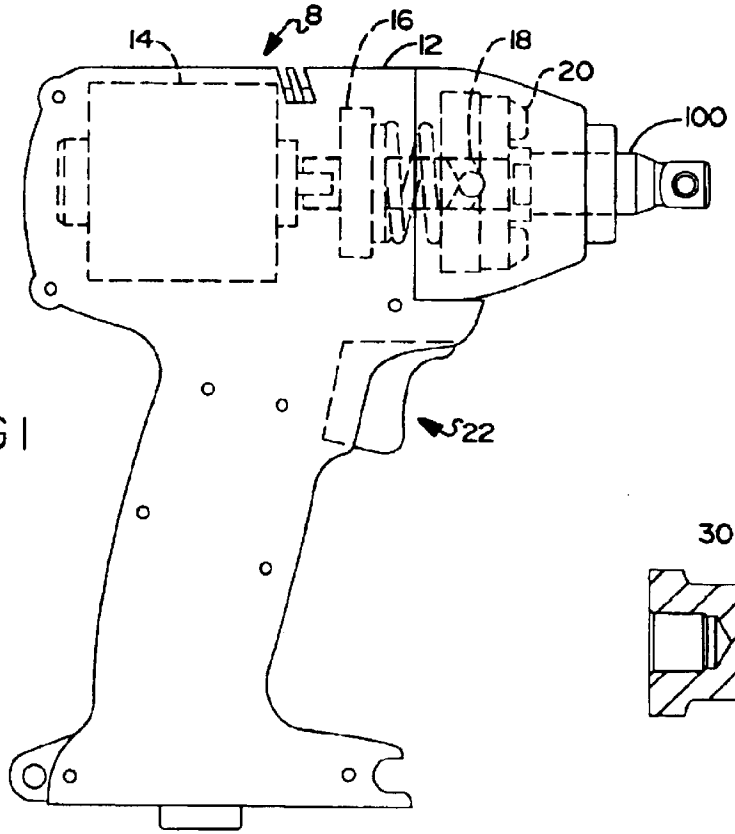
FIG. 1 is a side view of an exemplary impact wrench having an anvil constructed according to the principles of the present invention.

With reference to FIG. 1 of the drawings, an exemplary impact wrench 8 is illustrated to include an improved anvil 100 that is constructed in accordance with the teachings of the present invention. The impact wrench 8 also includes a housing 12 containing an electric motor 14 whose output is coupled to a gear assembly 16. The gear assembly 16 transfers the output to a cam and carrier 18 which in turn drives an impactor 20. The improved anvil 100 is mounted within the impactor 20. A trigger and handle assembly 22 mounted to the housing 12 is used to activate the electric motor 14.

With reference now to FIG. 2, a prior art anvil is indicated by reference numeral 10. The prior art anvil 10 includes a round body 30 and a square drive head 32. A transition zone 34 connects the round body 30 to the square drive head 32, as will be described in greater detail below.

The round body 30 is generally cylindrical in shape and includes an enlarged base 36 at one end thereof. The enlarged base 36 includes two locking wings 38 extending therefrom and adapted to be received within the impactor 20. A base radius 40 extends around the circumference of the enlarged base 36 and extends to the round body 30 thereby connecting the two portions.

The square drive head 32 includes side faces 42 and a front face 44. A détente pin hole 46 extends from one of the side faces 42 through the drive head 32. The détente pin hole 46 is sized to receive a détente pin, not shown. A roll pin hole 48 extends from another side face 42 into the square drive head 32. The square drive head 32 is adapted to be inserted into a tool piece, not shown.

The transition zone 34 includes a tapered ramp 52 extending from the round body 30 to the square drive head 32. Sharp radii 54 are formed at the corners of the square drive head 32 where the faces 42 meet the tapered ramp 52. These sharp radii 54 form stress concentration zones and are the sources of potential material failure of the anvil 10.

Figure 4:
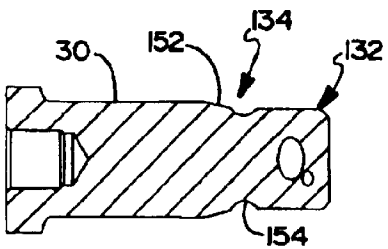
FIG. 4 is a cross-sectional view of the anvil of FIG. 3.

With reference now to FIGS. 3 and 4, the improved anvil 100 will now be described in detail. The improved anvil 100 includes the round body 30 of the prior art design. However, the improved anvil 100 includes an improved square drive head 132 and an improved transition zone 134.

The improved square drive head 132 includes side faces 142 and a front face 144. A détente pin hole 146 extends from one of the side faces 142 through the improved square drive head 132. The détente pin hole 146 is sized to receive a détente pin, not shown. A roll pin hole 148 extends from the front face 144 into the improved square drive head 132. The roll pin hole 148 is offset from the longitudinal axis of the anvil 100. A cutout 149 surrounds the roll pin hole 148 and aids in the removal of the roll pin (not shown) for maintenance purposes. The reorientation of the roll pin hole 148 to the front face 144 of the anvil 100 rather than through the side faces 42 (as illustrated in FIG. 2) decreases the amount of stress applied to the improved square drive head 132, thereby increasing its lifespan. The improved square drive head 132 is adapted to receive a tool piece, not shown.

With reference now to FIG. 4, and continued reference to FIG. 3, the transition zone 134 includes a tapered ramp 152 extending from the round body 30 to the improved square improved square drive head 132. It should be understood that the tapered ramp can be eliminated by making the square head and round body of the same general diameter. The improved anvil 100 design introduces a removal of material in the transition zone 134 between the round body 30 and improved square drive head 132 of the anvil 100, specifically at the tapered ramp 152. This removal of material forms a radius 154 around the circumference at the tapered ramp 152. As shown in FIG. 4, the cross-sectional area of the anvil 100 at the radius 154 is smaller than the cross-sectional area of the square drive head 132.

The radius 154 eliminates the sharp radii 54 (FIG. 2) seen on the prior art design and eliminates these stress concentration zones and potential sources of failure in the anvil 100. Specifically, the prior art anvil 10 (FIG. 2) experiences a load of 975 Mpa of stress on the square drive head 32 through the radii zone 54 when tested under a work load. The improved anvil 100 experiences a load of 414 Mpa of stress on the square drive head 132 through the transition zone 134 into the round body 30 when tested under the same work load. Accordingly, the anvil 100 has an improved lifespan over the prior art design (FIG. 2).

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An anvil for use with an impact wrench, the anvil comprising:

a round body;

a square head formed at an end of the round body, said square head defining four flat side surfaces;

a recessed radius portion formed in between the square head and the round body and a tapered ramp extending around the circumference of the round body and tapered toward sides of the square head, said recessed radius portion extending radially inward from an entirety of said four flat side surfaces around the circumference of the tapered ramp.

2. The anvil of claim 1, wherein the square head and round body define a longitudinal axis, and the square head includes a roll pin hole adapted to receive a roll pin, the roll pin hole extending into the square head parallel to the longitudinal axis of the round body.

3. The anvil of claim 2, wherein the square head further includes a recessed portion surrounding the roll pin hole.

4. The anvil of claim 1, wherein a cross sectional area of the anvil at the radius is less than a cross sectional area of the anvil at the square head.

5. An impact wrench comprising:

a housing;

a motor mounted within the housing;

an anvil driven by the motor, the anvil including a round body and a square head formed at an end of the round body, said square head defining four flat side surfaces, and a recessed radius portion formed between the square head and the round body and a tapered ramp extending around the circumference of the round body and tapered toward sides of the square head, said recessed radius portion extending radially inward from an entirety of said four flat side surfaces around the circumference of the tapered ramp.

6. The impact wrench of claim 5, wherein the square head and round body define a longitudinal axis, and the square head includes a roll pin hole adapted to receive a roll pin, the roll pin hole extending into the square head parallel to the longitudinal axis of the round body.

7. The impact wrench of claim 6, wherein the square head further includes a recessed portion surrounding the roll pin hole.

8. The impact wrench of claim 5, wherein a cross sectional area of the anvil at the radius is less than a cross sectional area of the anvil at the square head.

* * * * *

UNITED STATES PATENT AND TRADEMARK OFFICE

CERTIFICATE OF CORRECTION

PATENT NO. : 6,938,526 B2
DATED : September 6, 2005
INVENTOR(S) : Rodney Milbourne et al.

It is certified that error appears in the above-identified patent and that said Letters Patent is hereby corrected as shown below:

Title page,
Item [75], Inventors, insert -- Beverly Kivett, Columbia, MD (US) --.

Signed and Sealed this

Sixteenth Day of May, 2006

JON W. DUDAS
*Director of the United States Patent and Trademark Office*